US006217383B1

(12) United States Patent
Holland et al.

(10) Patent No.: US 6,217,383 B1
(45) Date of Patent: Apr. 17, 2001

(54) COAXIAL CABLE CONNECTOR

(75) Inventors: Michael Holland, Santa Barbara, CA (US); Yeh Min-Hua, Taipei (TW)

(73) Assignee: Holland Electronics, LLC, Ventura, CA (US)

( * ) Notice: Subject to any disclaimer, the term of this patent is extended or adjusted under 35 U.S.C. 154(b) by 0 days.

(21) Appl. No.: 09/599,059

(22) Filed: Jun. 21, 2000

(51) Int. Cl.[7] ..... H01R 9/05

(52) U.S. Cl. ..... 439/578

(58) Field of Search ..... 439/578, 583, 439/584

(56) References Cited

U.S. PATENT DOCUMENTS

| | | | | |
|---|---|---|---|---|
| 5,024,606 | * | 6/1991 | Ming-Hwa | 439/578 |
| 5,470,257 | * | 11/1995 | Szegda | 439/578 |
| 6,053,769 | * | 4/2000 | Kubota et al. | 439/578 |
| 6,109,964 | * | 8/2000 | Kooiman | 439/578 |

* cited by examiner

*Primary Examiner*—Brian Sircus
*Assistant Examiner*—Phuong Kt Dinh
(74) *Attorney, Agent, or Firm*—Michael G. Petit

(57) ABSTRACT

A compression-type coaxial cable connector having a leading end, a trailing end and integral construction is described. The connector includes a nut at the leading end of the connector, a tubular shank having a flange on a leading end thereof and a barb concentrically disposed on a trailing end, a slotted body portion and a compression sleeve slidably attached to the body portion forming the trailing end of the connector. The connector, and each of the components associated therewith, has an axial conduit coextensive with the length thereof. When the prepared end of a coaxial cable is inserted into the trailing end of the connector conduit and advanced through the conduit into the body portion, the shank separates the outer protective jacket and conductive braid of the cable from the dielectric core and interposes the barbed portion of the tubular shank therebetween. Subsequent advancement of the compression sleeve over the body portion, with the assistance of a compression tool, compresses the cable jacket and braid in two locations providing secure attachment. Following compression, further advancement of the compression sleeve is stopped when an annular ridge within the compression sleeve engages a groove in the outer surface of the slotted body portion, thereby providing a stable mechanical connection between the cable and connector. A first "O" ring disposed between the tubular shank and the nut, and a second "O" ring disposed between the slotted body portion and compression sleeve, provide a moisture seal. The construction of the slotted body portion and the compression sleeve minimizes the possibility of installation errors.

6 Claims, 5 Drawing Sheets

COAXIAL CABLE CONNECTOR

BACKGROUND OF THE INVENTION

1. Field of the Invention

The present invention relates to connectors for electrically connecting a coaxial cable to a threaded port.

2. Prior Art

The design and construction of F-type coaxial cable connectors, such as those commonly used for transmitting cable TV signals, digital data lines and home satellite systems, has changed in recent years in order to comply with changing industry standards and FCC regulations. Currently, connectors must exhibit a low RF leakage level, even in exposed environments. A moisture-proof seal between the connector and the conductor(s) within a coaxial cable is essential to prevent corrosion and RF leakage.

Connectors adapted to form a secure, electrically conductive connection between a coaxial cable and a threaded female port have been developed. Such prior art connectors are discussed, for example, in U.S. Pat. Nos. 5,024,605 to Ming-Hua, 4,280,749 to Hemmer, 4,593,964 to Forney, Jr. et al., 5,007,861 to Stirling, 5,073,129 to Szegda and 5,651,699 to Holliday. U.S. Pat. No. 5,879,191 to Burris, discusses prior art efforts to provide a coaxial connector which is moisture-proof and minimizes radiative loss of signal from the cable. A radial compression type of coaxial cable connector of the type generally used today, is described in detail in U.S. Pat. No. 5,632,651 to Szegda, and the disclosure of Szegda '651 relating to radial compression coaxial cable connectors is incorporated herein by reference thereto.

While the innovative plethora of prior art connectors, some of which are disclosed above, provide improved moisture sealing and/or RF leakage characteristics, all have inherent limitations. For example, the integrity of the attachment between the cable and connector is "craft sensitive", depending on the skill of the installer. The steps required in order to provide a secure, sealing engagement between a connector and a coaxial cable include opportunities for installation errors to occur. Installation of a coaxial cable connector on a coaxial cable requires that the end of the cable first be prepared to receive the connector. The connector is then manually forced onto the prepared end of the cable until the protective jacket and underlying conductive braid of the cable are separated from the dielectric core of the cable. The cable is further advanced into the connector by hand, which requires the application of substantial force by the installer, until the correct depth of insertion is attained. Finally, the connector is securely affixed to the cable by compressing the connector, again by hand, with a compression tool. With most prior art connectors, during the compression step, the cable jacket and conductive braid are compressed against an annular barb disposed on the surface of an underlying tubular shank during the final several millimeters of compressive travel. If the installer fails to completely compress the connector, especially in the final 20 percent of the compressive range, the connector may come loose. Incorrect installation will result in unacceptable levels of RF leakage.

Prior art connectors rely on a single point of compression (i.e., between the annular barb on the tubular shank and the body portion of the connector) for secure attachment to a coaxial cable. Accordingly, the barb on the tubular shank has a relatively high profile or angular pitch, which high profile makes it difficult to force the prepared end of a coaxial cable into the connector. A connector having a single point of compression requires the cable to have a jacket thickness lying within a small range of tolerances. Recent developments in building codes require that coaxial cable installed in particular locations within a structure, such as plenum areas, air return ducts and elevator shafts, have fire retardent jacketing materials. Such new jacketing materials have different physical properties than the standard coaxial cables previously used, such as elasticity, smoothness and thickness, which renders prior art connectors less than optimal for use therewith. The skilled artisan will appreciate that it would be an advancement in the art to provide a cable connector wherein the annular barb on the tubular shank has a relatively low profile, enabling the connector to accommodate the facile insertion of coaxial cable having a variety of thicknesses, elasticity and/or smoothness, and be securely attached to the cable. Accordingly, there remains a need for a cable connector that is impermeable to moisture, can be used with a variety of cable jacket and braid thicknesses and is easy to install with minimum chance for error.

SUMMARY

It is a first object of the invention to provide a coaxial cable connector that is resistant to the ingress of moisture.

It is a further object of the invention to provide a coaxial cable connector that may be easily inserted over the prepared end of a coaxial connector with a minimum amount of force.

It is yet another object of the invention to provide a coaxial cable connector that meets the above-stated objectives and is of integral construction, having no separable parts.

It is still another object of the invention to provide a coaxial cable connector that can be securely attached to a variety of coaxial cables having a broad range of jacket thicknesses.

The present invention provides a compression-type coaxial cable connector meeting the objectives of the invention. The connector, in accordance with the present invention, is of integral construction and includes a nut, a tubular shank, a slotted body portion, two "O" rings and a compression sleeve. The nut, as with all of the elements comprising the connector, has an axial conduit therethrough, the nut conduit having a threaded forward end with a first diameter and a trailing end having a second diameter that is less than the first diameter. A first "O" ring having an outer diameter substantially equal to the first diameter, is disposed within the axial conduit of the nut forward of and adjacent the trailing end. The tubular shank is an elongate, generally cylindrical tube having a leading end with a flange thereon, and a trailing end. The flange is disposed within the conduit of the nut forward of the first "O" ring, with the trailing end, which includes an annular barb disposed circumfrentially thereon, projecting rearwardly through the trailing end of the axial conduit within the nut.

The slotted body portion acts cooperatively with the compression sleeve to provide two points of radial compression of the outer jacket and conductive braid of the cable; a first point being disposed between the slotted body portion and the tubular shank, and a second point disposed between the compression sleeve and the barb on the tubular shank as will be discussed below. The slotted body portion is a substantially cylindrical member having a leading end, a trailing end and an axial conduit coextensive with the length thereof. The diameter of the conduit within the slotted body portion is stepped, having a smaller diameter in the leading end than in the trailing end. The trailing end of the conduit wall is slotted longitudinally and has a plurality of annular gripping ridges thereon. The leading end of the slotted body portion is compression fitted to an annular shoulder on the tubular shank, the shoulder being disposed rearward of the trailing end of the nut, to concentrically overlie the tubular shank. A trailing portion of the tubular shank extends rearwardly from the trailing end of the slotted body portion, the extended portion including the relatively low profile annular barb disposed near the trailing end of the tubular shank.

As mentioned above, the tubular shank includes a shoulder adjacent the leading end thereof disposed rearward of the flange. When the stepped inner diameter of the leading end of the conduit within the slotted body portion is compression fitted to the shoulder on the tubular shank, the slotted body portion is prevented from moving with respect to the tubular shank and the nut is rotatably mounted on, and locked to, the tubular shank. After the slotted body portion is compression fitted to the shoulder of the tubular shank, the nut, the first "O" ring, the tubular shank and the slotted body portion are locked into a subassembly having integral construction. The slotted trailing end of the slotted body portion has three annular grooves and one annular ridge on the outer surface thereof. The first, forwardmost annular groove houses a second "O" ring. The annular ridge on the outer surface of the body portion is diposed rearwardly of the first annular groove between the second and third annular grooves. The third, rearwardmost annular groove provides means for attaching a compression sleeve to the aforesaid subassembly.

The compression sleeve is a substantially cylindrical member having a leading end, a trailing end and an axial conduit coextensive with the length thereof. The diameter of the conduit within the compression sleeve is stepped in three stages, with the largest diameter at the leading end of the conduit and the least diameter at the trailing end of the conduit. The leading end of the compression sleeve conduit has an annular ridge projecting radially inwardly from the conduit wall. When the leading end of the compression sleeve is advanced forwardly over the trailing end of the slotted body portion, the annular ridge within the conduit of the compression sleeve engages the third, rearwardmost groove on the slotted body portion to form a compressible coaxial cable connector assembly having integral construction.

When the prepared end of a coaxial cable is inserted into the trailing end of the compression sleeve conduit, and advanced forwardly through the slotted body portion, the trailing end of the tubular shank forces the cable jacket and braid over the relatively low profile barb into an annular space between the shank and the body portion to overlie the tubular shank forward of the barb as well as over the barb. Advancement of the compression sleeve over the body portion compresses the cable jacket in two places: (a) between the compression sleeve and the barb on the tubular shank; and (b) between the tubular shank and the gripping ridges within the conduit of the slotted body portion. Further advancement of the compression sleeve is terminated when the annular ridge within the conduit of the compression sleeve "snaps" into, and engages, the second, middle groove in the outer surface of the body portion. The cable jacket and braid are radially compressed where they overlie the barb and where they underlie the gripping ridges, as well as over the barb, thereby providing a stable two-point connection.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1A:
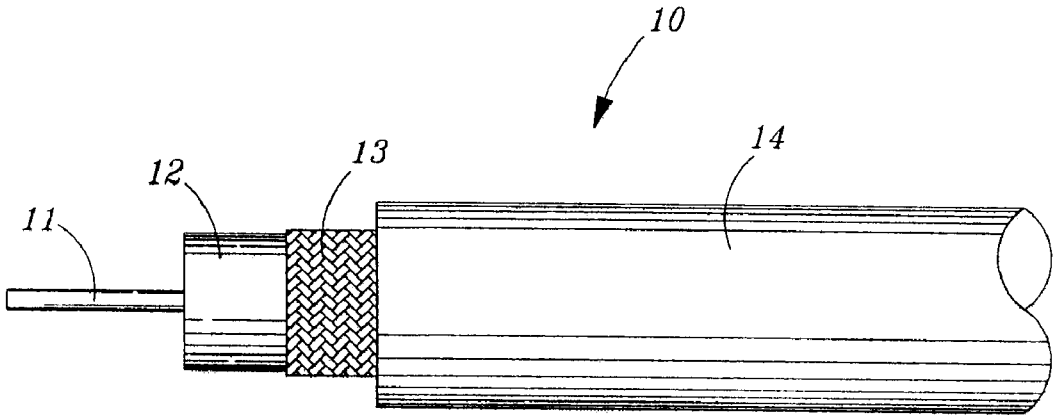
FIG. 1*a* is an elevational view showing the prepared end of a coaxial cable.
Figure 1B:
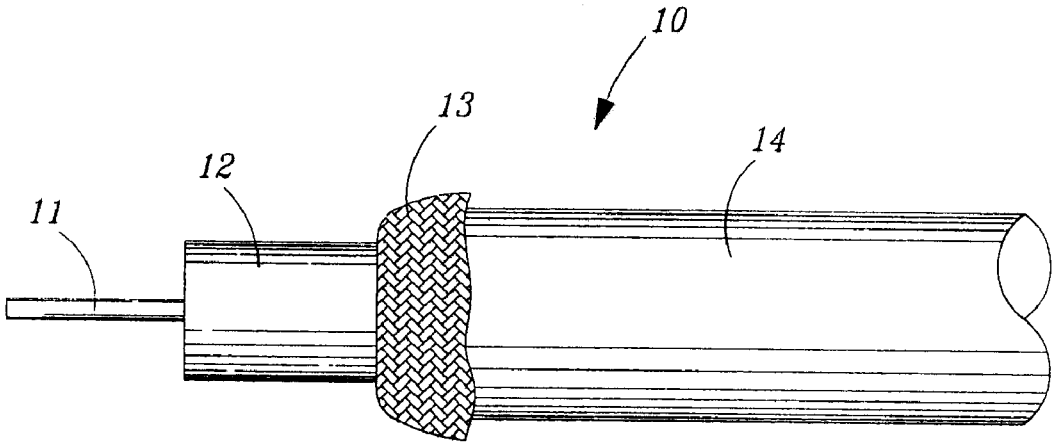
FIG. 1*b* an elevational view showing the prepared end of a coaxial cable illustrated in FIG. 1*a* with the conductive braid folded back to overlie a portion of the protective jacket.
Figure 7:
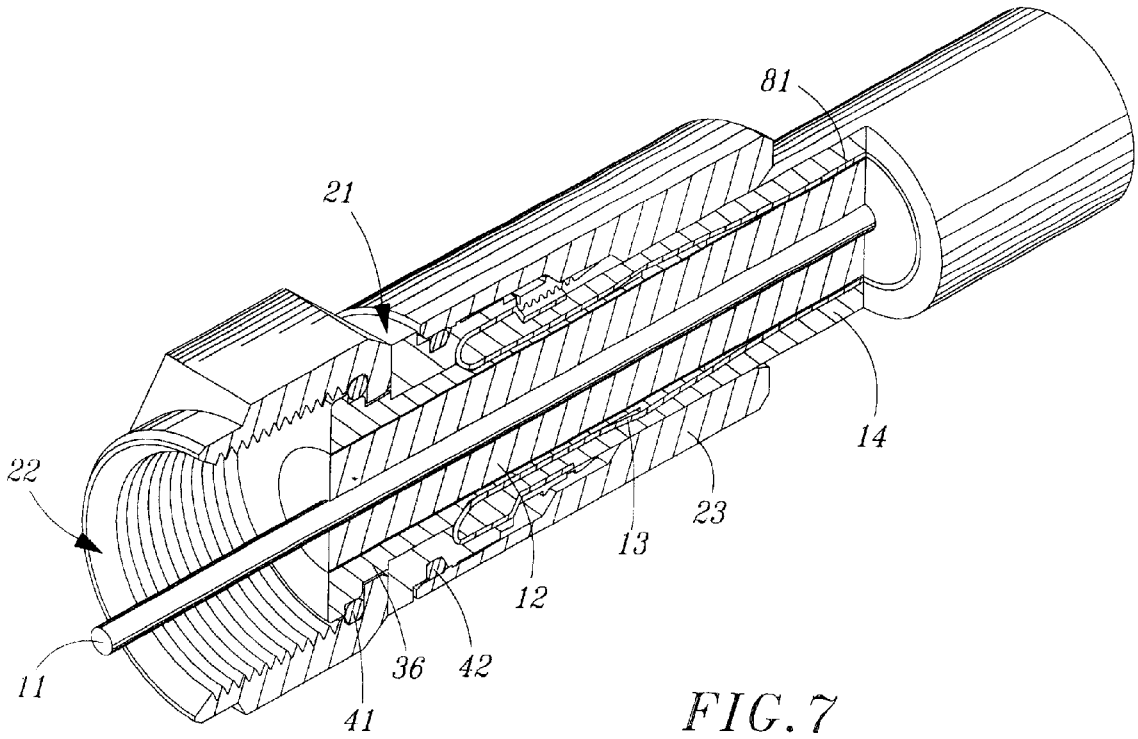
FIG. 7 is a perspective cutaway view of a connector in accordance with the present invention, illustrating the relationship between cooperating parts of the connector in locking engagement with the prepared end of a coaxial cable.

Turning now to FIG. 1*a*, the partially prepared (i.e., stripped) end of a coaxial cable 10 is shown in elevational view. Prior to coupling a coaxial cable to a connector, the end of the cable to receive the connector must first be prepared. A cutting tool (not shown) is used by an installer to expose a portion of the central conductor 11, a length of the dielectric core 12 and a conductive (grounding) braid 13, as shown in FIG. 1*a*. The respective lengths of each of the elements comprising the coaxial cable 10 that are exposed by the cutting tool are in accordance with industry standards. Following exposure of the conductive braid 13, the exposed portion of conductive braid 13 is flared and folded back to overlie the protective jacket 14 as shown in FIG. 1*b*. The coaxial cable 10 may further include one or more layers of an electrically conductive foil 81 underlying the conductive braid, as shown in FIG. 7. The thickness of the conductive braid may vary, depending on the manufacturer, and require the application of different amounts of force by the installer in order to correctly position the cable end within the connector prior to attachment.

Figure 2:
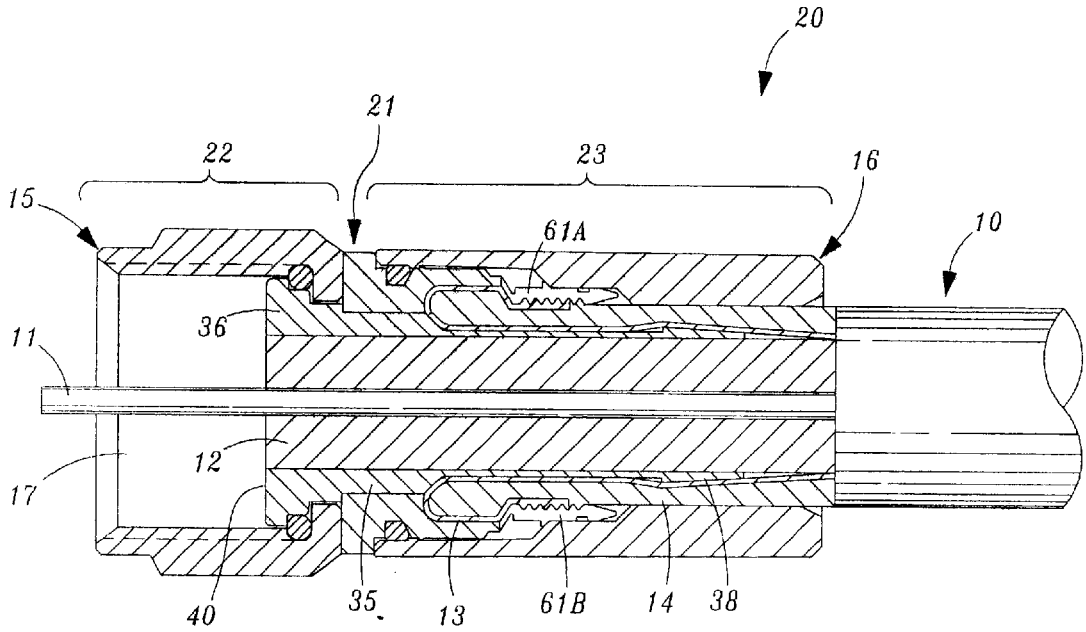
FIG. 2 is a cross-sectional view of a coaxial cable connector in accordance with the present invention shown attached to a prepared end of a coaxial cable.

A coaxial cable-connector assembly is shown in cross-sectional view in FIG. 2. The connector 20 is a generally cylindrical member having a leading end 15, a trailing end 16 and an axial lumen 17 coextensive with the length thereof and having integral construction. A threaded nut 22 forms the leading end of the connector 20 and a compression sleeve 23 forms the trailing end. The tubular shank 36 has a flange 40 on the leading end thereof and an annular barb 38 on the trailing end thererof. The slotted body portion 21 has a leading end which is compression fit to lockingly engage and grip a shoulder 35 on the tubular shank 36. The compression sleeve 23 has an annular ridge 33 (shown more clearly in FIGS. 3 and 5) on the inner cylindrical conduit, which matingly engages an annular groove 48 (FIG. 4) in the outer surface of the body portion 21. The exposed portion of the conductive braid 13 of the cable 10, and a portion of the protective jacket underlying the (folded back) exposed conductive braid, is housed and compressed within the annular chamber formed between the tubular shank and the overlying body portion and compression sleeve. The connector provides two compression points to securely hold the cable such that the central conductor 11 is correctly positioned for engagement with a female receptacle (not shown). The first or forwardmost cable compression point underlies gripping ridges within the trailing end of the slotted body portion and the second compression point underlies the compression sleeve and overlies the annular barb on the tubular shank. The two compression points, which collectively provide secure attachment between the cable and connector while reducing the diameter or profile of the annular barb 38, are made possible by extending the trailing end of the tubular shank, including the barb, rearward of the trailing end of the slotted body portion to underlie the trailing end 16 of the compression sleeve 23. A pair of "O" rings 41 and 42 provide a moisture seal between the nut and tubular shank, and the slotted body portion and compression sleeve respectively.

Figure 3:
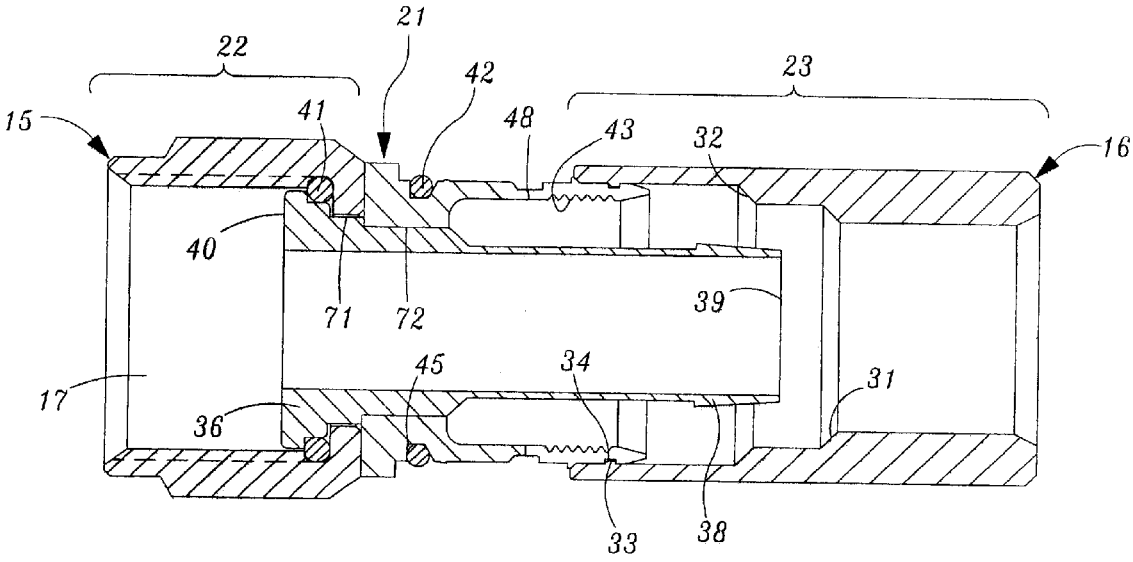
FIG. 3 is a cross-sectional view of the coaxial cable connector in accordance with FIG. 2, prior to the insertion of the coaxial cable thereinto.

A cross-sectional longitudinal view of the uncompressed coaxial cable connector 20, shown in FIG. 2, illustrating the connector 20 prior to insertion of the prepared end of a coaxial cable thereinto, is shown in FIG. 3. The connector 20 is a generally cylindrical member having a leading end 15 and a trailing end 16 and an axial conduit 17 therebetween. The diameter of the opening at the trailing end of the threaded nut 22 is dimensioned to snugly accommodate the passage of a first shouder 71 on the tubular shank 36 therethrough. A first "O" ring 41 is interposed between the flange 40 on the leading end of the tubular shank 36 and the trailing end of the nut 22 to provide a moisture seal therebetween. The leading end of the slotted body portion 21 is compression fitted to a second shoulder 72 on the tubular shank and securely attached thereto. The leading end of the conduit within the compression sleeve 23 has an annular ridge 33 therewithin that matingly engages an annular groove 34 on the outer surface of the slotted body portion near the trailing end thereof. The engagement between the annular ridge 33 and groove 34 permits forward movement of the compression sleeve relative to the slotted body portion when a compressive force is applied, but prevents rearward movement when traction is applied.

Figure 4:
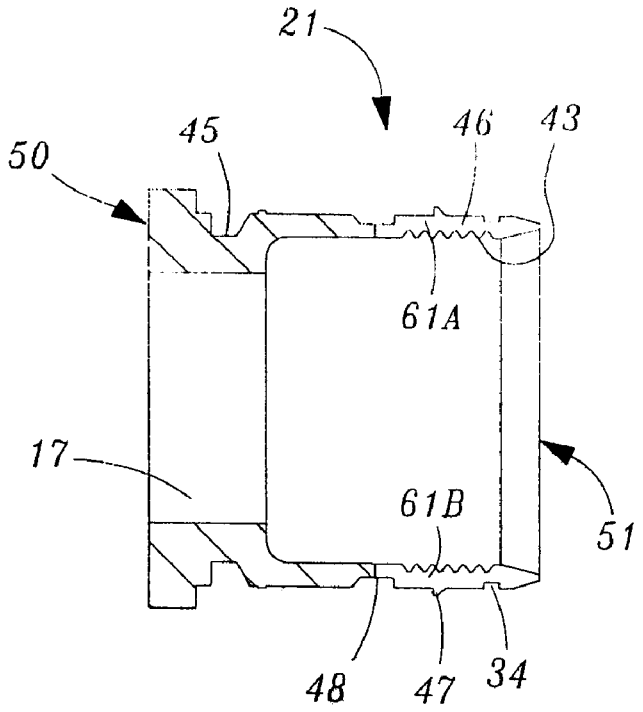
FIG. 4 is a longitudinal cross-sectional view of the slotted body portion of the coaxial coaxial connector of FIGS. 2–3.
Figure 6:
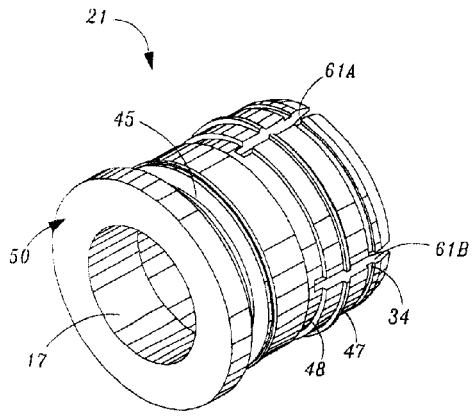
FIG. 6 is a perspective view of the slotted body portion of the connector shown in FIG. 4, viewed from the leading end thereof, illustrating the annular ridge and plurality of grooves on the outer surface thereof.

The slotted body portion 21 of the connector 20 is shown in longitudinal cross-sectional view in FIG. 4, and in perspective view in FIGS. 6 and 7. As stated above, the diameter of the conduit 17 in the leading end 50 of the slotted body portion 21 is dimensioned to compression fit over the second shoulder 72 of the tubular shank, thereby integrating the nut, tubular shank and slotted body portion into a unified subassembly. The outer surface of the slotted body portion 21 includes a first annular groove 34, a second annular groove 48 and an annular ridge 47 therebetween. The inner surface of the axial conduit 17 within the slotted body portion 21 has at least one, and more preferably a plurality, of gripping ridges 43 on the wall thereof, circumfrentially disposed near the trailing end 51 of the slotted body portion. A plurality of slots, two of which are shown at 61*a* and 61*b*, in the wall of the slotted body portion, shown more clearly in perspective view in FIG. 6, extend rearwardly from annular groove 48 to the trailing end 51 of the slotted body portion. The slots 61*a* and 61*b* permit substantial reduction in the diameter of the trailing end of the slotted body portion when a radially compressive force is applied. Thus, the diameter of the conduit within the slotted trailing end of the slotted body portion can be made larger than if the body portion lacked such slots. The larger (non-compressed) diameter of the conduit in the trailing end of the slotted body portion enables the facile insertion of a variety of coaxial cables having a range of cable diameters thereinto. The second "O" ring 42 (FIGS. 3 and 7) is disposed within an annular recess 45 near the leading end of the slotted body portion.

Figure 5:
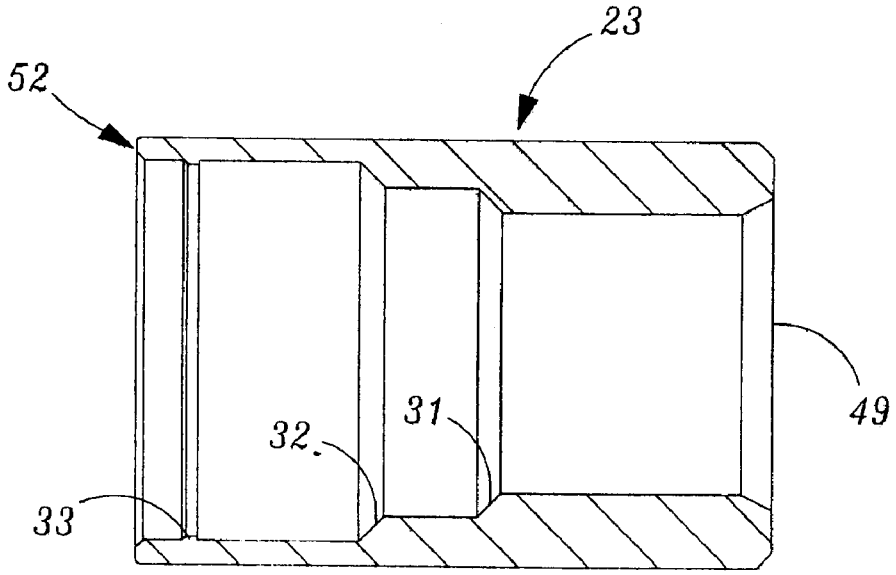
FIG. 5 is a longitudinal cross-sectional view illustrating the compression sleeve of the coaxial coaxial connector of FIGS. 2–3.

The compression sleeve 23 is a cylyindical member having an axial conduit coextensive with the length thereof, the axial conduit 17 having a stepped diameter within the compression sleeve, the steps indicated at numerals 31 and 32 as illustrated in longitudinal cross-sectional view in FIG. 5. The compression sleeve 23 includes an annular ridge 33 disposed circumfrentially on the conduit wall adjacent the leading end 52 thereof. When the leading end 52 of the compression sleeve is inserted and advanced over the trailing end 51 of the slotted body portion, the slots 61*a* and 61*b* on the slotted body portion enable the trailing end thereof to be elastically compressed radially inwardly by the step 32 within the compression sleeve when the compression sleeve is advanced. Further advancement of the compression sleeve over the slotted body portion is terminated when the annular ridge 33 engages the rearmost trailing groove 34 on the slotted body portion. The engagement between the ridge 33 and trailing groove 34 prevents retraction of the compression sleeve from engagement with the slotted body portion but permits further advancement of the compression sleeve over the slotted body portion when sufficient force is applied, as, for example, by an installer's compression tool.

In order to attach the connector 20 to a coaxial cable 10, the prepared end of the coaxial cable, as illustrated in FIG. 1*b*, is inserted into the trailing end 16 of the connector conduit 17 and advanced thereinto until the central conductor 11 projects from the leading end of the connector. The compression sleeve is then further advanced over the slotted body portion using a suitable compression tool. As the compression sleeve advances, the beveled steps 32 and 31 within the axial conduit of the compression sleeve progressively compress the jacket and braid in two places: (a) between the gripping ridges 43 within the slotted body portion and the outer surface of the tubular shank; and (b) between the compression sleeve and the barb. Compression of the connector is terminated when the annular ridge 33 "snaps" into and engages the forward annular groove 48 in the slotted body portion. The pressure of the compression sleeve on the annular ridge 47 disposed on the outer surface of the slotted body portion urges the gripping ridges 43 against the cable jacket and braid to form a secure connection which supplements the point of attachment provided by the barb and reinforces the attachment of the connector to the coaxial cable. FIG. 7 is a perspective cutaway view of a connector in accordance with the present invention, illustrating the relationship between cooperating parts of the connector in locking engagement with the prepared end of a coaxial cable.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A connector for coupling the end of a coaxial cable to a threaded port wherein the coaxial cable has an axial conductor, a coaxial layer of a dielectric surrounding the conductor, an electrically conductive grounding sheath surrounding the dielectric layer, and a protective outer jacket surrounding the grounding sheath, said connector comprising:

(a) a connector subassembly comprising; i) a nut having an axial conduit with an internally threaded leading end and a trailing end; ii) a tubular shank having an axial conduit, a leading end with a flange thereon disposed concentrically within said axial conduit of said nut, and a trailing end extending rearwardly from said trailing end of said nut, said tubular shank having an annular shoulder on an outer surface thereof disposed rearwardly of and adjacent to said trailing end of said nut, and an annular barb disposed on said outer surface adjacent to said trailing end; and iii) a slotted body portion having a generally cylindrical shape with a leading end, a trailing end, an axial conduit therebetween, and a plurality of slots extending forwardly from said trailing end, and a first annular locking groove in an outer surface of said body portion; and iv) a first "O" ring disposed between said flange on said tubular shank and said trailing end of said nut; and (b) a compression sleeve non-releasably attached to said slotted body portion of said connector subassembly, said compression sleeve being a substantially cylindrical member having a leading end, a trailing end and an axial conduit therebetween, said axial conduit having an annular ridge adjacent the leading end thereof that matingly engages said first annular locking groove on said outer surface of said slotted body portion and non-releasably attaches said compression sleeve to said connector subassembly.

2. The connector in accordance with claim 1 wherein said axial conduit within said compression sleeve has a diameter and wherein said diameter decreases at first and second stepped transitions disposed between said leading end and said trailing end of said axial conduit.

3. The connector in accordance with claim 1 wherein said slotted body portion further comprises at least one annular gripping ridge disposed within said axial conduit of said slotted body portion and an annular ridge on said outer surface of said slotted body portion disposed to concentrically overlie said gripping ridge.

4. The connector in accordance with claim 2 wherein said slotted body portion further comprises at least one annular gripping ridge disposed within said axial conduit of said slotted body portion, and an annular ridge on said outer surface of said slotted body portion disposed to concentrically overlie said gripping ridge.

5. The connector of claim 4 wherein said slotted body portion further comprises a second annular locking groove on said outer surface thereof disposed between said annular ridge and said leading end of said slotted body portion, said second annular locking groove being operable for matingly and non-releasably engaging said annular ridge within said axial conduit of said compression sleeve when said compression sleeve is advanced toward said leading end of said slotted body portion.

6. The connector of claim 5 further comprising a second "O" ring disposed within an annular "O" ring groove on said outer surface of said slotted body portion between said second locking groove and said leading end.

* * * * *